US009483002B2

(12) United States Patent
Hazeyama et al.

(10) Patent No.: US 9,483,002 B2
(45) Date of Patent: Nov. 1, 2016

(54) IMAGE FORMING APPARATUS CONFIGURED TO CONTROL ROTATIONAL SPEED OF PRESSURE ROLLER USING TEMPERATURE OF HEAT UNIT AND PARAMETER

(71) Applicant: Brother Kogyo Kabushiki Kaisha, Nagoya-shi, Aichi-ken (JP)

(72) Inventors: Tomoaki Hazeyama, Yokkaichi (JP); Yasuhiro Maruyama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/920,946

(22) Filed: Oct. 23, 2015

(65) Prior Publication Data

US 2016/0116875 A1 Apr. 28, 2016

(30) Foreign Application Priority Data

Oct. 23, 2014 (JP) ..... 2014-215899

(51) Int. Cl.
*G03G 15/20* (2006.01)

(52) U.S. Cl.
CPC ..... *G03G 15/2085* (2013.01); *G03G 15/2078* (2013.01)

(58) Field of Classification Search
CPC ..... G03G 15/2039; G03G 2215/2035; G03G 15/2053; G03G 15/205; G03G 15/2042; G03G 15/2064; G03G 15/2085; G03G 15/2078; H05B 2203/013; H05B 3/0095; H05B 3/141
See application file for complete search history.

(56) References Cited

U.S. PATENT DOCUMENTS

| | | | | |
|---|---|---|---|---|
| 5,819,149 | A | 10/1998 | Watanabe et al. | |
| 7,218,874 | B2 | 5/2007 | Tomiyori et al. | |
| 8,010,030 | B2 * | 8/2011 | Senda | G03G 15/206 399/329 |
| 2005/0158066 | A1 | 7/2005 | Tomiyori et al. | |
| 2011/0311249 | A1 | 12/2011 | Kubota et al. | |
| 2012/0148280 | A1 * | 6/2012 | Sato | G03G 15/2039 399/68 |
| 2015/0093136 | A1 * | 4/2015 | Koda | G03G 15/2039 399/68 |

FOREIGN PATENT DOCUMENTS

| | | | |
|---|---|---|---|
| JP | H07-261584 | A | 10/1995 |
| JP | H08-016028 | A | 1/1996 |
| JP | H09-319282 | A | 12/1997 |
| JP | H11-095603 | A | 4/1999 |
| JP | 2001-240262 | A | 9/2001 |
| JP | 2005-196054 | A | 7/2005 |
| JP | 2007-102083 | A | 4/2007 |
| JP | 2007-298720 | A | 11/2007 |
| JP | 2012-013821 | A | 1/2012 |

* cited by examiner

*Primary Examiner* — Francis Gray
(74) *Attorney, Agent, or Firm* — Banner & Witcoff, Ltd.

(57) ABSTRACT

An image forming apparatus includes a heat unit, a pressure roller, a temperature sensor, and a controller. The heat unit includes a heater and a heated member configured to be heated by the heater. The pressure roller is configured to rotate at a rotational speed while being in contact with the heated member upon receiving a driving force. The temperature sensor is configured to detect a temperature of the heat unit. The controller is configured to control the rotational speed of the pressure roller on a basis of: the temperature detected by the temperature sensor; and a parameter that causes temperature of the pressure roller to change.

20 Claims, 7 Drawing Sheets

IMAGE FORMING APPARATUS CONFIGURED TO CONTROL ROTATIONAL SPEED OF PRESSURE ROLLER USING TEMPERATURE OF HEAT UNIT AND PARAMETER

CROSS REFERENCE TO RELATED APPLICATION

This application claims priority from Japanese Patent Application No. 2014-215899 filed Oct. 23, 2014. The entire content of the priority application is incorporated herein by reference.

TECHNICAL FIELD

The present disclosure relates to an image forming apparatus, and a method for controlling the image forming apparatus.

BACKGROUND

An electro-photographic type image forming apparatus such as a laser printer is provided with a fixing device including a heating member and a pressure roller. The heating member is a fusing belt heated by a heater, and the pressure roller is configured to be rotated while contacting the heating member. The pressure roller has a roller portion whose diameter is changed by the expansion thereof due to increase in temperature. As a result, in the fixing device in which a sheet is conveyed upon input of driving force into the pressure roller, sheet conveying speed may be changed due to change in peripheral velocity of the pressure roller, which is caused by the change in the diameter of the pressure roller.

Japanese Patent Application publication No. 2007-298720 discloses a fixing device provided with a thermistor for detecting temperature of a cored bar of the pressure roller, so that a rotation speed of the pressure roller is controlled on a basis of the temperature detected by the thermistor.

SUMMARY

According to the disclosed structure, the thermistor is in contact with the core bar. Therefore, grease leaked out of a boundary between the fusing belt and the fixing roller may smear the core bar, so that the grease may be entered into a gap between the thermistor and the cored bar due to the rotation of the cored bar, thereby smearing the thermistor. Thus, accurate temperature detection by the thermistor cannot be performed, so that accurate control to a rotation speed of the pressure roller cannot be made.

It is therefore an object of the present disclosure to provide an image forming apparatus, and a method and program for controlling the image forming apparatus capable of accurately controlling rotational speed of the pressure roller in accordance with a change in the diameter of the pressure roller, the change being caused by the temperature change.

In order to attain the above and other objects, the disclosure provides an image forming apparatus including a heat unit, a pressure roller, a temperature sensor, and a controller. The heat unit includes a heater and a heated member configured to be heated by the heater. The pressure roller is configured to rotate at a rotational speed while being in contact with the heated member upon receiving a driving force. The temperature sensor is configured to detect a temperature of the heat unit. The controller is configured to control the rotational speed of the pressure roller on a basis of: the temperature detected by the temperature sensor; and a parameter that causes temperature of the pressure roller to change.

According to another aspect, the disclosure provides a method including: detecting a temperature of a heat unit with a temperature sensor provided in an image forming apparatus, the heat unit including a heater and a heated member configured to be heated by the heater; and controlling a rotational speed of a pressure roller provided in the image forming apparatus on a basis of: the detected temperature; and a parameter that causes temperature of the pressure roller to change, the pressure roller configured to rotate while in contact with the heated member upon receiving a driving force.

According to another aspect, the disclosure provides a non-transitory computer readable storage medium storing a set of program instructions executed by a computer, the program instructions including: detecting a temperature of a heat unit with a temperature sensor provided in an image forming apparatus, the heat unit including a heater and a heated member configured to be heated by the heater; and controlling a rotational speed of a pressure roller provided in the image forming apparatus on a basis of: the detected temperature; and a parameter that causes temperature of the pressure roller to change, the pressure roller configured to rotate while in contact with the heated member upon receiving a driving force.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
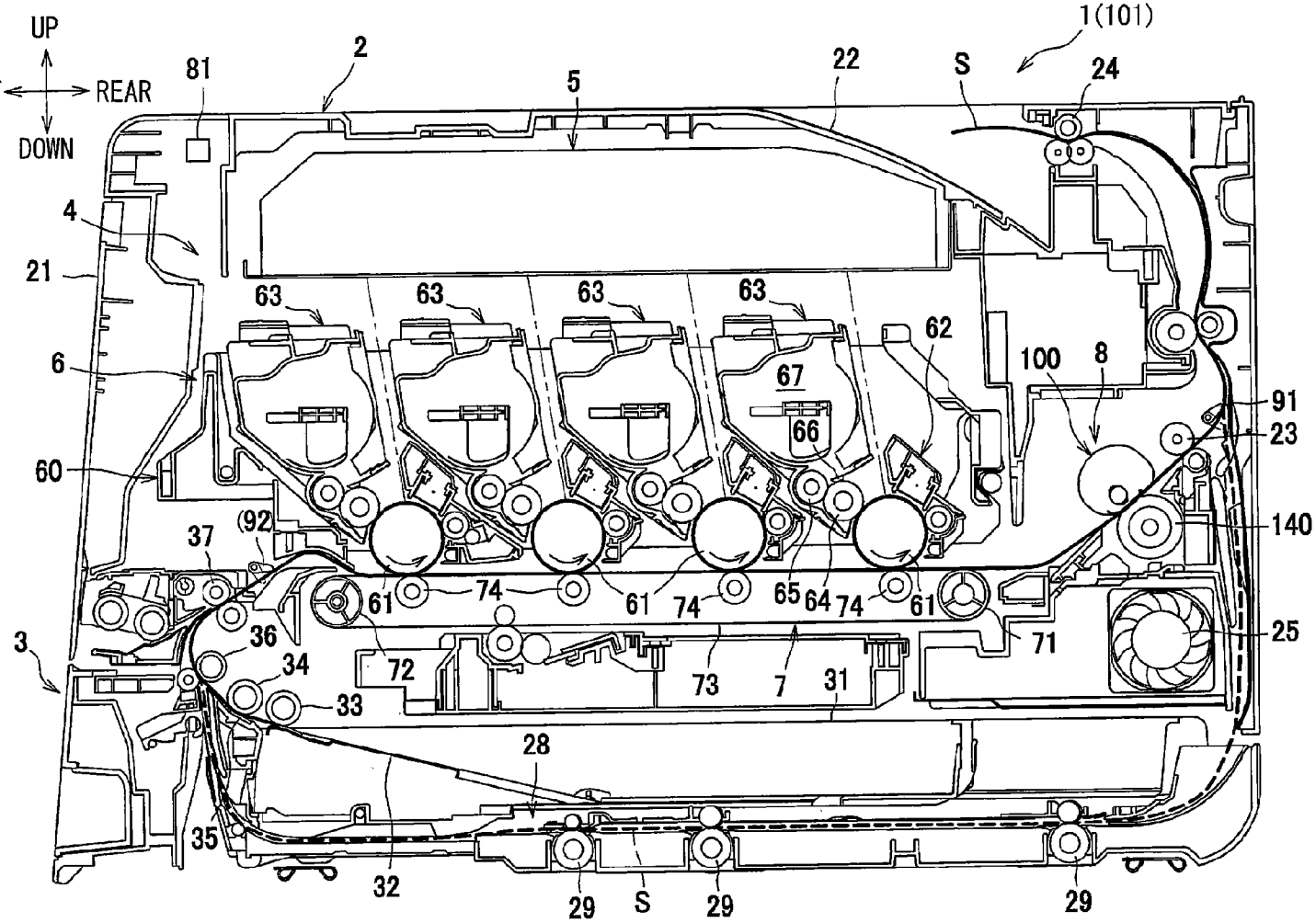
FIG. 1 is a schematic view showing a general construction of a color laser printer as an example of an image forming apparatus according to first and second embodiments.

A color laser printer 1 as an example of an image forming apparatus according to a first embodiment will be described while referring to FIGS. 1 through 6.

Directions in the following description will be based on an orientation of the color laser printer 1 shown in FIG. 1. Specifically, the left side of the color laser printer 1 in FIG. 1 will be called the "front," the right side will be called the "rear," the near side will be called the "right," and the far side will be called the "left." Further, the "top" and "bottom" of the printer 1 will correspond to the vertical direction in FIG. 1.

The color laser printer 1 is configured to form images on both surfaces of a sheet S of a plain paper. As shown in FIG. 1, the printer 1 includes a housing 2 as an example of a housing. Within the housing 2, primarily provided are a sheet supply unit 3, an exposure unit 5, a process unit 6, a transfer unit 7, and a fixing unit 8. The exposure unit 5, the process unit 6, and the transfer unit 7 constitute in combination an image forming unit 4 for forming a developer image on the sheet S.

The sheet supply unit 3 is provided in a bottom portion of the housing 2. The sheet supply unit 3 primarily includes a sheet supply tray 31 for accommodating therein sheets S, a lifter plate 32, a sheet supply roller 33, a separation roller 34, a separation pad 35, a conveying roller 36, and a registration roller 37. In the sheet supply unit 3, the sheets S accommodated in the sheet supply tray 31 are urged toward the sheet supply roller 33 by the lifter plate 32, and the sheets S are fed out by the sheet supply roller 33. Then, the separation roller 34 and the separation pad 35 are configured to separate the sheets S one by one, and the conveying roller 36 and the registration roller 37 are configured to supply the separated sheet S to the image forming unit 4.

The exposure unit 5 is provided in an upper portion of the housing 2. Although not shown in the drawings, the exposure unit 5 includes a plurality of laser light-emitting units, a polygon mirror, lenses, reflecting mirrors, and the like. The exposure unit 5 is configured to irradiate laser beams (indicated by dotted chain lines in FIG. 1) in a high-speed scan to expose the surfaces of corresponding photosensitive drums 61 to light on a basis of image data.

The process unit 6 is arranged between the sheet supply tray 31 and the exposure unit 5, and primarily includes a drawer 60, four photosensitive drums 61, a plurality of chargers 62, and a plurality of developing cartridges 63. The plurality of chargers 62 and the plurality of photosensitive drum 61 are provided in one-to-one correspondence. The plurality of developing cartridges 63 and the plurality of photosensitive drum 61 are provided in one-to-one correspondence. Each developing cartridge 63 includes a developing roller 64, a supply roller 65, a toner layer thickness regulation blade 66, and a toner chamber 67. The toner chamber 67 is configured to accommodate toner (developer) therein. In each developing cartridge 63, toner in the toner chamber 67 is supplied to the developing roller 64 by the supply roller 65, and the toner on the surface of the developing roller 64 is maintained at a uniform thickness by the corresponding thickness-regulating blades 66.

The drawer 60 is configured to retain the four photosensitive drums 61, and is movable relative to the housing 2 in the frontward/rearward direction. The housing 2 has a front portion formed with an opening which is covered by a front cover 21. The drawer 60 is detachable from the housing 2 when the front cover 21 is opened. Specifically, the drawer 60 can be pulled out of the housing 2 and be attached into the housing 2 through the opening by opening the front cover 21. Further, the photosensitive drums 61 are can be replaced by new drums along with the drawer 60. Further, each developing cartridge 63 is detachably attached to the drawer 60. Thus, the developing cartridge(s) can be replaced by new cartridge(s) while the drawer 60 is pulled out of the housing 2.

In the process unit 6, each charger 62 applies a uniform charge to the surface of the corresponding photosensitive drum 61, after which the exposure unit 5 irradiates laser beams to expose surface of the corresponding photosensitive drum 61 to light for forming an electrostatic latent image thereon. Then, the toner carried on the surface of each developing roller 64 is supplied to the electrostatic latent image formed on the corresponding photosensitive drum 61 to produce a visible toner image (developer image) on the corresponding photosensitive drum 61.

The transfer unit 7 is provided between the sheet supply tray 31 and the process unit 6. The transfer unit 7 primarily includes a driving roller 71, a driven roller 72, a conveyer belt 73 looped over the driving roller 71 and the driven roller 72 in a taut state, and four transfer rollers 74. The conveyer belt 73 is an endless belt and has an outer surface in contact with each photosensitive drum 61. The transfer rollers 74 are arranged on the inside of the loop formed by the conveyer belt 73 at positions so that the transfer rollers 74 and the respective photosensitive drums 61 nip the conveyer belt 73 therebetween. A sheet S supplied onto the conveyer belt 73 is conveyed between the photosensitive drums 61 and the transfer rollers 74, whereby the toner images formed on the photosensitive drums 61 are transferred to and superposed on the sheet S.

Figure 2:
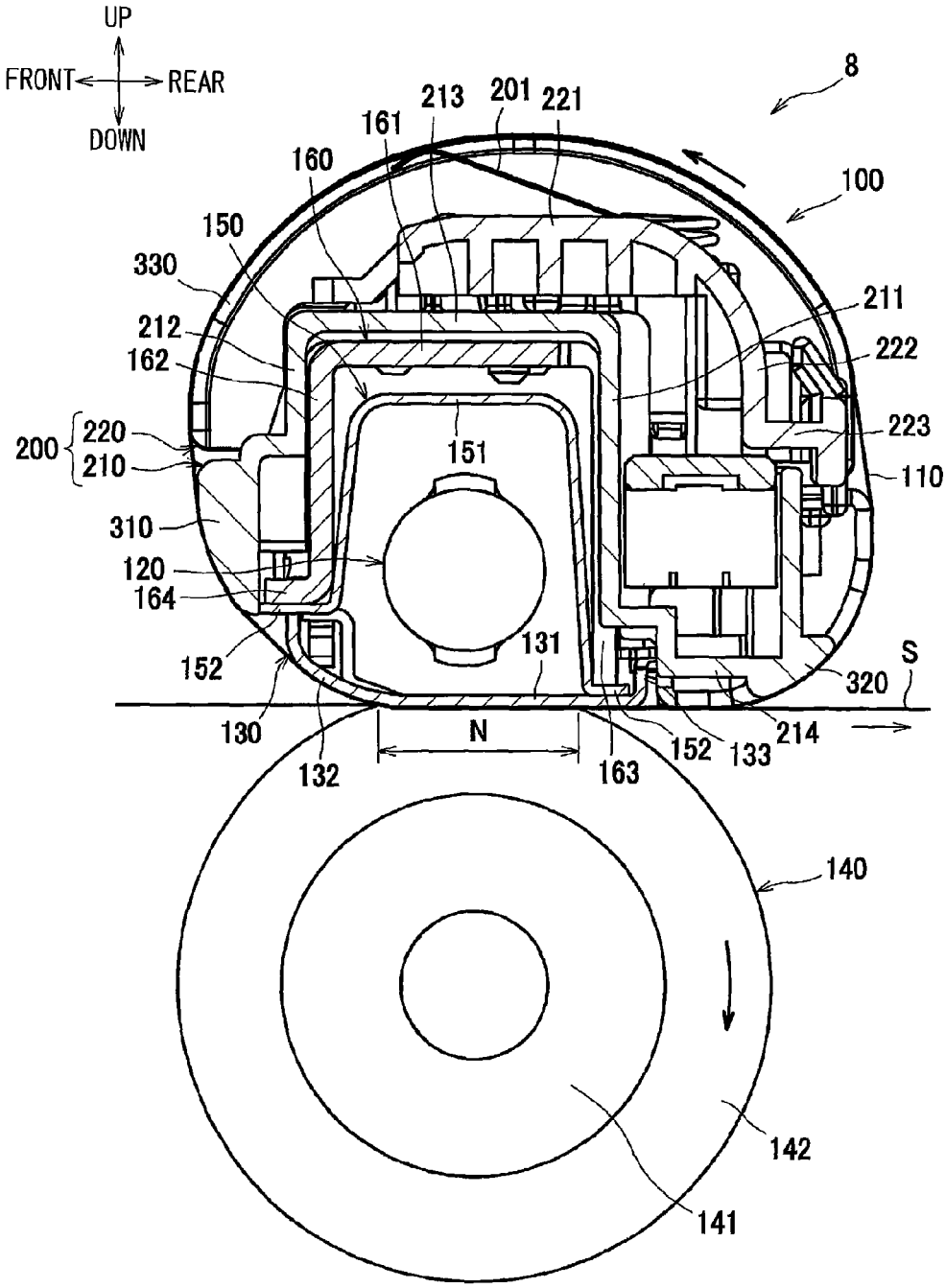
FIG. 2 is a cross-sectional view illustrating an essential portion of a fixing device in the printer according to the first and second embodiments.
Figure 3:
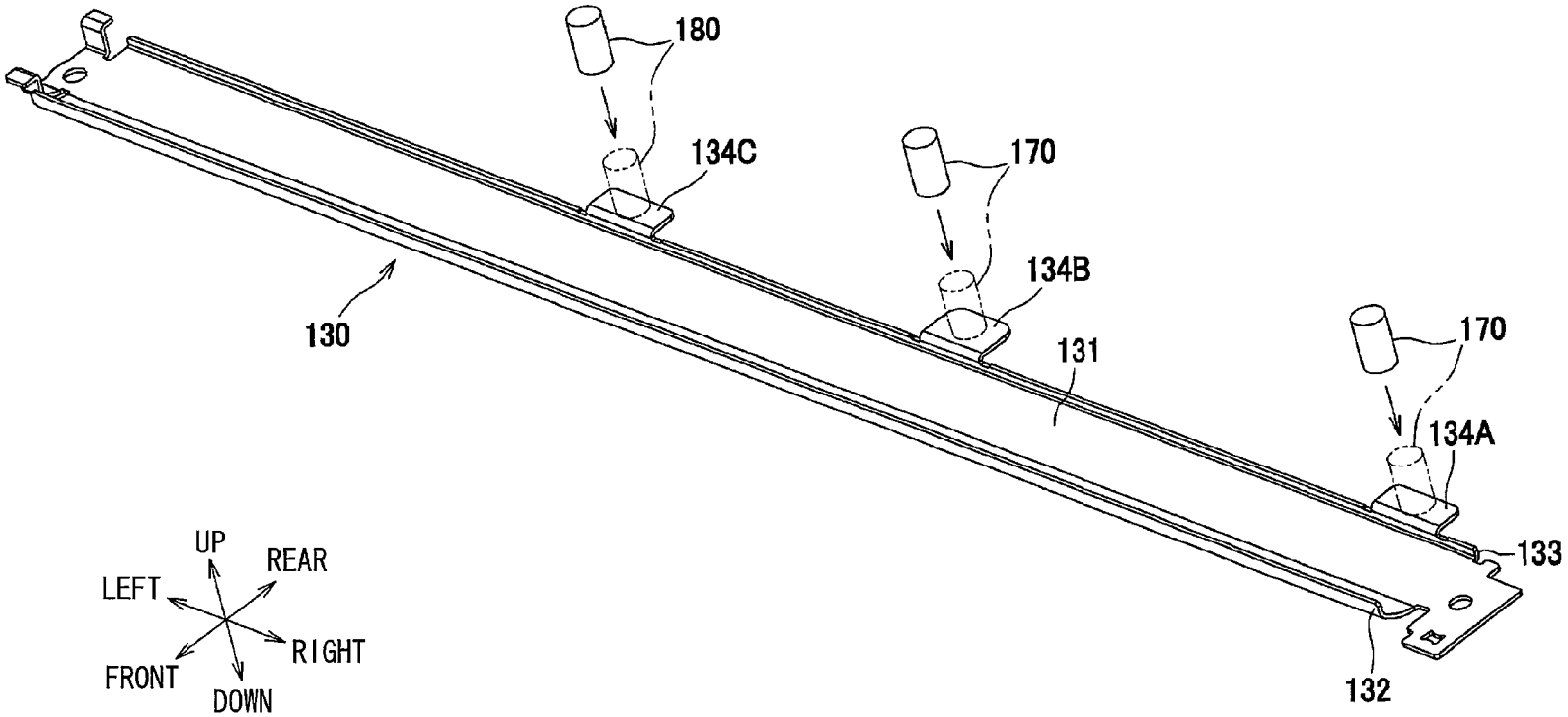
FIG. 3 is a perspective view of a nip plate in the fixing device.

The fixing unit 8 is disposed rearward of the process unit 6, and includes a heat unit 100, and a pressure roller 140. As illustrated in FIGS. 2 and 3, the heat unit 100 includes a fusing belt 110 as an example of a heated member, a halogen lamp 120 as an example of a heater, a nip plate 130 as an example of a nip member, a reflection plate 150, a stay 160, thermistors 170 as an example of a temperature sensor, and a thermostat 180.

As shown in FIG. 2, the fusing belt 110 is a tubular member such as an endless belt having heat resistivity and flexibility. The fusing belt 110 is configured of a tube formed of a metal such as stainless steel, and a coating layer such as fluorine resin formed on an outer peripheral surface of the metal tube. The fusing belt 110 is disposed so as to be capable of circulating counterclockwise in FIG. 2 while being guided by a upstream guide 310, a downstream guide 320 and an end guide 330 formed in a cover member 200. A wire spring 201 is provided to the cover member 200 for applying tension to the fusing belt 110. Further, grease (not shown) is provided at an inner peripheral surface of the fusing belt 110 in order to enhance slidability between the fusing belt 110 and the nip plate 130.

The halogen lamp 120 is a heater configured to heat the nip plate 130 and the fusing belt 110 in order to heat toner transferred onto the sheet S. The halogen lamp 120 is disposed in an internal space defined by the inner circumferential surface of the fusing belt 110 while being spaced apart at a prescribed distance from the inner circumferential surface of the fusing belt 110.

The nip plate 130 is a plate-like member that receives radiant heat from the halogen lamp 120. The nip plate 130 is disposed in the internal space of the fusing belt 110 so as to be spaced apart at a prescribed distance from the halogen lamp 120. More specifically, the nip plate 130 contacts the inner circumferential surface of the fusing belt 110 while nipping the fusing belt 110 in cooperation with the pressure roller 140. The nip plate 130 is provided by bending a metal plate such as aluminum plate whose coefficient of thermal conductivity is higher than that of the stay 160.

As shown in FIG. 3, the nip plate 130 includes a plate portion 131 elongated in the leftward/rightward direction, a front bent portion 132 extending upward from a front edge of the plate portion 131, a rear bent portion 133 extending upward from a rear edge of the plate portion 131, and three detected portions 134A, 134B, 134C extending rearward from an upper edge of the rear bent portion 133.

As shown in FIG. 2, the pressure roller 140 is disposed below the nip plate 130 so as to nip the fusing belt 110 in cooperation with the nip plate 130. The pressure roller 140 is configured to convey the sheet S in cooperation with the fusing belt 110, while the fusing belt 110 is nipped between the nip plate 130 and the pressure roller 140. The pressure roller 140 includes a shaft 141 made from metal such as steel, and an elastic roller body 142 provided around a circumferential surface of the shaft 141. The pressure roller 140 and the heat unit 100 are urged toward each other, so that a portion of the roller body 142 contacting the nip plate 130 with the fusing belt 110 interposed therebetween elastically deforms to form a nip portion N with the fusing belt 110.

Figure 4:
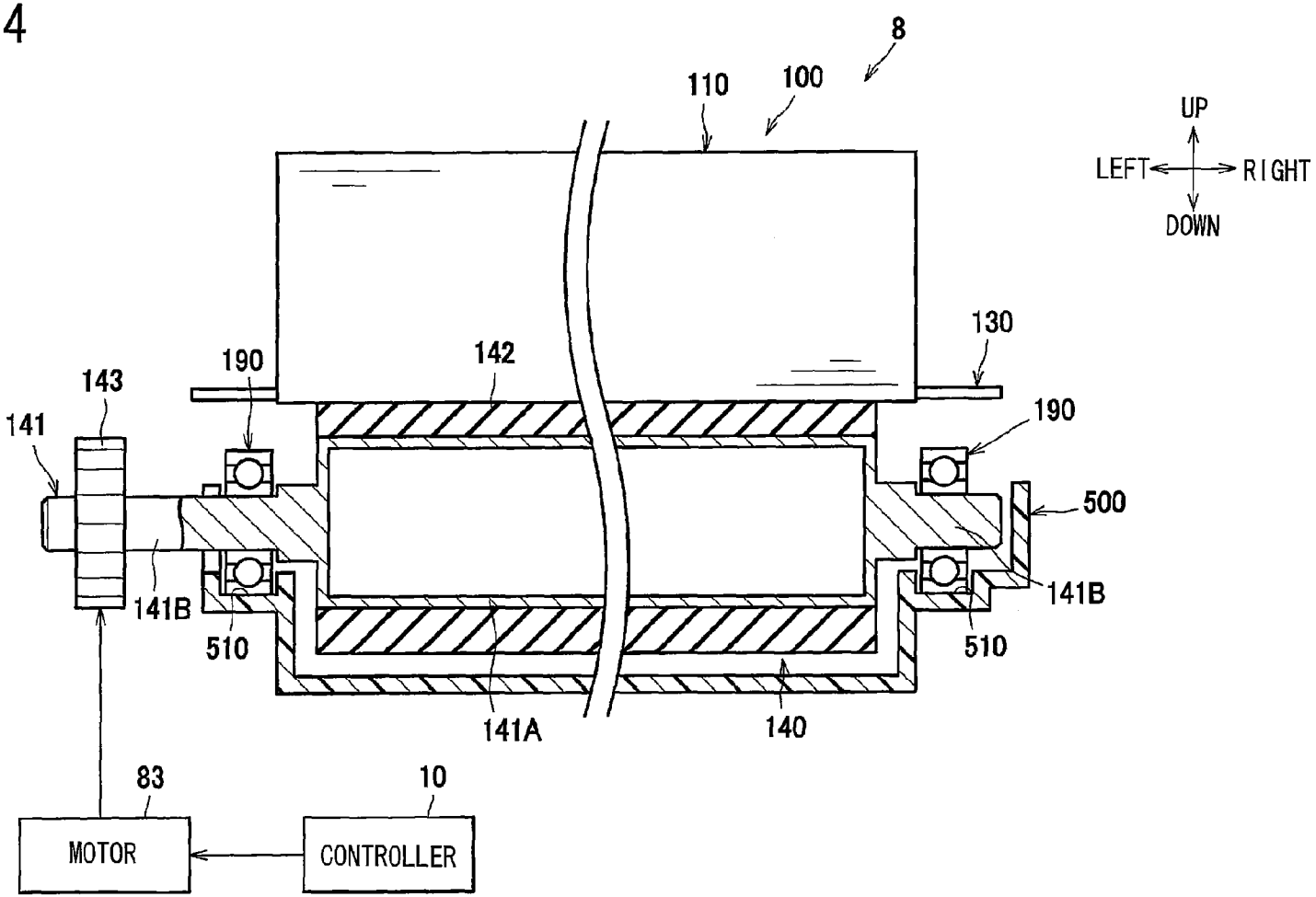
FIG. 4 is a view illustrating the fixing device, a motor, and a controller according to the first and second embodiments.

A drive input gear 143 is coupled to an end portion of the shaft 141 of the pressure roller 140 as shown in FIG. 4, so that the roller body 142 is configured to rotate about an axis of the shaft 141 upon input of a driving force to the input gear 143 while the roller body 142 is in contact with the fusing belt 110. In other words, the pressure roller 140 is configured to rotate at a rotational speed while being in contact with the fusing belt 10 upon receiving the driving force. The fusing belt 110 is circularly moved upon rotation of the pressure roller 140, to thus convey the sheet S in cooperation with the heat unit 100.

The reflecting member 150 is a member that reflects the radiant heat from the halogen lamp 120 toward the nip plate 130. The reflecting member 150 is disposed in the internal space of the fusing belt 110 so as to surround the halogen lamp 120. The reflecting member 150 is formed by bending an aluminum plate or the like. The reflecting member 150 includes a reflecting portion 151 having a general U-shape in cross-section, and flange portions 152 extending outward in the frontward/rearward direction from respective ends of the reflecting portion 151.

The stay 160 is a member supporting the nip plate 130 via the flange portions 152 of the reflection plate 150 so as to ensure rigidity of the nip plate 130 against load from the pressure roller 140. The stay 160 is disposed in the internal space of the fusing belt 110 so as to surround the reflection plate 150. The stay 160 is formed by bending a steel plate into a generally U-shape in cross-section. The stay 160 includes an upper wall 161, a front wall 162 extending downward from a front end of the upper wall 161, a rear wall 163 extending downward from a rear end of the upper wall 161, and a flange portion 164 extending frontward from a lower end of the front wall 162.

FIG. 3 shows the thermistors 170 and the thermostat 180 are configured to detect temperature of the heat unit 100, and the thermistors 170 and the thermostat 180 are disposed in the internal space of the fusing belt 110. More specifically, the thermistors 170, 170 are faced with the detected portions 134A, 134B of the nip plate 130, respectively, and the thermostat 180 is faced with the detected portion 134C of the nip plate 130 so as to detect the temperature of the nip plate 130. Temperature data detected by the thermistors 170 are used for controlling the halogen lamp 120, that is, for controlling the temperature of the fixing unit 8. Incidentally, temperature control to the fixing unit 8 is well known, so that detailed description can be omitted. The thermostat 180 is connected to the halogen lamp 120 and is configured to shut off electrical power supply to the halogen lamp upon detection of a temperature exceeding a predetermined temperature.

As shown in FIG. 2, the cover member 200 is configured to support the halogen lamp 120, the nip plate 130, the reflection plate 150, the stay 160, the thermistors 170 and the thermostat 180, and includes a first cover 210 and a second cover 220.

The first cover 210 is elongated in the leftward/rightward direction and is made from resin having a given heat resistance. The first cover 210 is disposed in the internal space of the fusing belt 110 so as to surround the stay 160. The first cover 210 includes a rear side wall 211, a front side wall 212, an upper wall 213 connecting an upper edge of the rear side wall 211 and an upper edge of the front side wall 212, and an extension wall 214 extending rearward from a lower end of the rear side wall 211. The front side wall 212 has a lower end portion provided with the upstream guide 310 for guiding a front lower portion of the fusing belt 110. The extension wall 214 has a rear end portion provided with the downstream guide 320 for guiding a rear lower portion of the fusing belt 110.

The second cover 220 is elongated in the leftward/rightward direction and is made from resin having a given heat resistance. The second cover 220 is disposed in the internal space of the fusing belt 110 so as to cover the first cover 210. The second cover 220 includes an upper wall 221, a rear wall 222 extending downward from a rear end portion of the upper wall 221, and an extension wall 223 extending rearward from a lower end portion of the rear wall 222. The end guide 330 is formed at each leftward/rightward end portion of the upper wall 221 for guiding each leftward/rightward end portion of an upper portion of the fusing belt 110.

In the fixing unit 8, a toner image transferred onto the sheet S is thermally fixed to the sheet S by conveying the sheet S through a boundary between the heat unit 100 and the pressure roller 140. As shown in FIG. 1, the sheet S on which the toner image has been fixed is conveyed by a conveying roller 23 and a discharge roller 24. In a case where an image is formed at one of the surfaces of the sheet S (first surface), the sheet S is discharged onto a discharge tray 22. On the other hand, in a case where another image is also formed on another surface (second surface) of the sheet S (in a case where images should be formed on both surfaces of the sheet S), the sheet S is introduced into a re-conveyer passage 28 by reverse rotation of the discharge roller 24, and is supplied again into the image forming unit 4 by re-conveyer rollers 29, the conveying roller 36, and the registration roller 37. Thereafter, a toner image is formed on the other surface of the sheet S, and the image is thermally fixed to the other surface by the fixing unit 8, and then the sheet S is discharged onto the discharge tray 22 by the conveying roller 23 and the discharge roller 24.

In addition to the image forming unit 4 and the fixing unit 8, the color laser printer 1 also includes a fan 25, an ambient temperature sensor 81, a first detection sensor 91, a motor 83 (FIG. 4), and a controller 10 (FIG. 4). The controller 10 and the motor 83 can be provided in the fixing device 8, or can be provided outside the fixing device 8 such as in the housing 2.

The fan 25 is configured to cool the interior of the housing 2 and is provided at a discharge opening formed in a left side wall of the housing 2 as shown in FIG. 1. In the depicted embodiment, the fan 25 is positioned below the fixing unit 8 for cooling the interior of the housing 2, specifically for cooling the fixing unit 8 by discharging air in the interior of the housing 2 outside upon operation of the fan 25. The fan 25 is controlled with a conventional manner such that the fan 25 operates during image forming operation to the sheet S, and the fan 25 is stopped during stand-by state for waiting input of print instruction or print job containing image data to be used for printing the sheet S. Information as to state of the fan 25, such as actuating state of the fan 25 (fan is ON) or stopping state of the fan (fan is OFF) is transmitted to the controller 10.

The ambient temperature sensor 81 is a sensor for detecting temperature of ambience where the color laser printer 1 is provided, i.e., is a sensor for detecting room air temperature. The ambient temperature sensor 81 is provided at a suitable portion of the housing 2. Data as to the temperature detected by the ambient temperature sensor 81 (ambient temperature TA) is transmitted to the controller 10.

The first detection sensor 91 is configured to detect transit of the sheet S (i.e., existence or non-existence of the sheet S) conveyed in the housing 2. For example, the first detection sensor 91 includes an actuator pivotally moved upon abutment of the sheet S, and an optical sensor for detecting the pivotal movement of the actuator. The first detection sensor 91 is positioned downstream of the pressure roller 140 in a sheet conveying direction. More specifically, the first detection sensor 91 is positioned rearward and diagonally upward of the fixing unit 8. Data as to whether or not the sheet S passes through the first detection sensor 91 is transmitted to the controller 10.

As shown in FIG. 4, the fixing unit 8 includes a frame 500 supporting the pressure roller 140. The pressure roller 140 includes the shaft 141 made from metal, the roller body 142 made from rubber such as silicone rubber, and the drive input gear 143. The shaft 141 includes a cored bar portion 141A which is a hollow cylinder over which the roller body 142 is formed, and shaft portions 141B each extending outward in an axial direction of the pressure roller 140 from each axial end of the cored bar portion 141A. Each shaft portion 141B has a diameter smaller than that of the cored bar portion 141A. The drive input gear 143 is fixedly coupled to the left shaft portion 141B. The frame 500 has roller support portions 510 retaining bearings 190, and each shaft portion 141B is fitted with one of the bearings 190. Thus, the pressure roller 140 is rotatably supported to the frame 500.

The motor 83 is a drive source for applying driving force to the shaft 141 of the pressure roller 140 through the drive input gear 143. In the depicted embodiment, the motor 83 is provided independent of another motor (not shown) which is adapted for applying driving force to the sheet supply unit 3, the image forming unit 4, the conveying roller 23 and the discharge roller 24.

The controller 10 is configured to control the rotation speed of the pressure roller 140. More specifically, the controller 10 is a computer equipped with CPU, ROM and RAM, and is configured to execute a pre-stored program to perform a process for controlling the rotational speed of the pressure roller 140 on the basis of the temperature detected by the thermistor 170 and parameters effecting on the temperature of the pressure roller 140.

Specifically, the controller 10 first estimates the temperature of the pressure roller 140. Based on this estimated temperature, the controller 10 calculates a rate of change of velocity from a reference state of the sheet S conveyed by the pressure roller 140 (the state in which the pressure roller 140 is sufficiently cooled in the operating environment of the color laser printer 1). The controller 10 further sets a target rotational speed of the pressure roller 140 based on the calculated rate of change of velocity. The controller 10 sets the target rotational speed for the pressure roller 140 at equal intervals (every time a first period of time has elapsed). This first period of time may be set at one's discretion; for example, 0.1 seconds.

Figure 5:
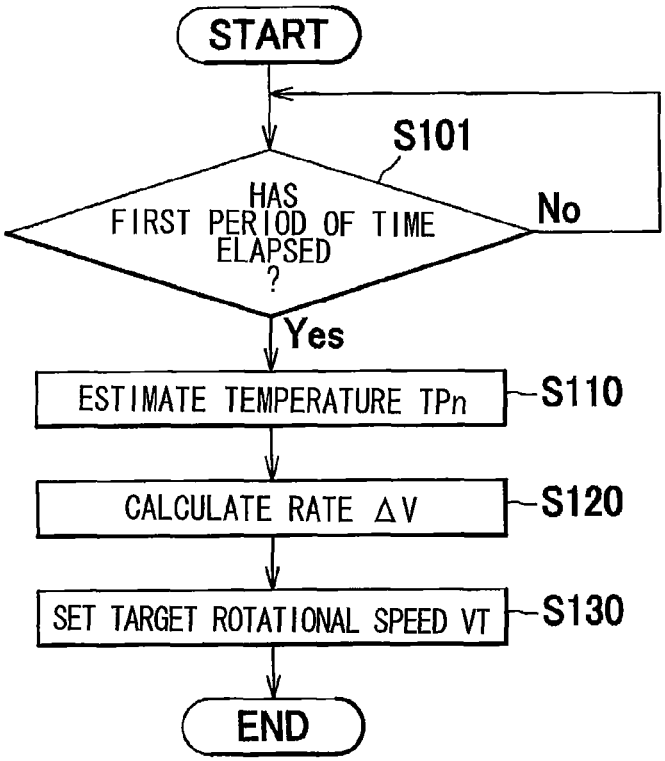
FIG. 5 is a flowchart illustrating a control routine executed in the controller for determining rotation speed of the pressure roller according to the first and second embodiments.

As shown in FIG. 5, the controller 10 determines in S101 whether the first period of time (0.1 seconds in this example) has elapsed. When the first time has elapsed (S101: YES), the controller 10 sequentially executes the processes in steps S110, S120, and S130. The process shown in FIG. 5 is executed repeatedly. In other words, the controller 10 starts the process of FIG. 5 every time the first time has been elapsed in S101.

1. Estimating the Temperature of the Pressure Roller

In S110 of FIG. 5, the controller 10 estimates a temperature $TP_n$ of the pressure roller 140 based on a temperature TH detected by the thermistors 170 and other parameters that may influence the temperature of the pressure roller 140 (and specifically, parameters that may influence the temperature of the roller body 142). As described above, the controller 10 executes the process of S110 repeatedly, thereby repeatedly update the estimated-temperature $TP_n$. In the first embodiment, parameters that could affect the temperature of the pressure roller 140 include the ambient temperature TA detected by ambient temperature sensor 81, the operating state of the fan 25, the presence of a sheet S between the fusing belt 110 and pressure roller 140 (i.e., the presence of a sheet S at the nip portion N), and the rotation or non-rotation of the pressure roller 140.

The controller 10 estimates the current temperature $TP_n$ of the pressure roller 140 by adding a change in temperature C to the previously estimated temperature of the pressure roller 140 (the penultimate estimated-temperature $TP_{n-1}$) as shown in equation (1) below.

$$TP_n = TP_{n-1} + C \qquad \text{equation (1)}$$

The change in temperature C is calculated by using $A_1(TN-TP_{n-1})$ as the first term, $A_2(TF_{n-1}-TP_{n-1})$ as the second term, and $A_3(TA-TP_{n-1})$ as the third term, as shown in equation (2) below.

$$C = A_1(TN-TP_{n-1}) + A_2(TF_{n-1}-TP_{n-1}) + A_3(TA-TP_{n-1}) \qquad \text{equation (2)}$$

The first term $A_1(TN-TP_{n-1})$ accounts for the influence on the temperature of the pressure roller 140 exerted by the status at the nip portion N between the fusing belt 110 and the pressure roller 140 (specifically, whether a sheet S is present at the nip N and whether the pressure roller 140 is rotating). This first term is calculated by multiplying the difference between a temperature TN at the nip portion N and the penultimate estimated temperature $TP_{n-1}$ of the pressure roller by a predetermined first coefficient $A_1$.

When a sheet S is present between the fusing belt 110 and the pressure roller 140, the temperature TN at the nip portion N is set to a sheet temperature TS corresponding to the temperature of the sheet S. When a sheet S is not present between the fusing belt 110 and the pressure roller 140, the temperature TN is set to the temperature TH detected by the thermistors 170, regarded as the temperature at the nip portion N. In the first embodiment, the temperature of the sheet S is thought to be approximately equal to room temperature when the color laser printer 1 is forming an image on the first surface of the sheet S. Hence, the sheet temperature TS is set to the ambient temperature TA in this case. However, when the color laser printer 1 is forming an image on the second surface of the sheet S, the sheet S has already passed once through the fixing unit 8 causing its temperature to rise. Accordingly, the sheet temperature TS is set to the sum of the ambient temperature TA and a preset calibration temperature TB (TA+TB).

The controller 10 is configured to determine whether a sheet S is present between the fusing belt 110 and pressure roller 140 on the basis of output from the first detection sensor 91 disposed on the downstream side of the pressure roller 140. For example, the controller 10 can determine that a sheet S is between the fusing belt 110 and the pressure roller 140 while the sheet S is passing over the first detection sensor 91, and can determine that a sheet S is not present between the fusing belt 110 and the pressure roller 140 after the sheet S has passed the first detection sensor 91. Further, the temperature TH detected by the thermistors 170 may be set to the average temperature detected by both thermistors 170 (see FIG. 3) or the temperature detected by one specific thermistor 170.

The first coefficient $A_1$ is set to a different value depending on whether the pressure roller 140 is rotating or not. In the first embodiment, the first coefficient $A_1$ is set to 0 when the pressure roller 140 is not rotating, and is set to a different value depending on whether a sheet S is present between the pressure roller 140 and the fusing belt 110 when the pressure roller 140 is rotating. More specifically, the first coefficient $A_1$ is set to a value greater than 0 when the pressure roller 140 is rotating, which value is larger when a sheet S is not present between the pressure roller 140 and the fusing belt 110 than when a sheet S is present between the pressure roller 140 and fusing belt 110. Here, the controller 10 can determine whether the pressure roller 140 is rotating on the basis of its own data for controlling the rotation of the pressure roller 140.

The second term $A_2(TF_{n-1}-TP_{n-1})$ accounts for how the temperature of a member disposed around the pressure roller 140 influence the temperature of the roller body 142 of the pressure roller 140 and is calculated by multiplying the difference between a temperature $TF_{n-1}$ of the member around the pressure roller 140 and the penultimate estimated temperature $TP_{n-1}$ by a predetermined second coefficient $A_2$. A member disposed around the pressure roller 140 (and more specifically around the roller body 142) in this case may be the heating unit 100, the frame 500, and/or the shaft 141, for example.

The second coefficient $A_2$ is larger than the first coefficient $A_1$ when a sheet S is present between the pressure roller 140 and the fusing belt 110. The second coefficient $A_2$ is smaller than the first coefficient $A_1$ when a sheet S is not present between the pressure roller 140 and the fusing belt 110.

The controller 10 calculates a temperature $TF_n$ of the member around the pressure roller 140 (the temperature $TF_{n-1}$ in the second term) on the basis of the following equation (3).

$$TF_n=TF_{n-1}+\{A_4(TH-TF_{n-1})+A_5(TP_{n-1}-TF_{n-1})\} \quad \text{equation (3)}$$

In equation (3), $TF_{n-1}$ is the temperature previously calculated for member around the pressure roller 140, and $A_4$ and $A_5$ are preset coefficients. The coefficients $A_4$ and $A_5$ are larger than the first coefficient $A_1$ set when a sheet S is present between the pressure roller 140 and the fusing belt 110 and smaller than the second coefficient $A_2$. The coefficient $A_4$ is set larger than the coefficient $A_5$.

In equation (3), the term $A_4(TH-TF_{n-1})$ accounts for how the temperature TH detected by the thermistors 170, and more specifically heat emitted from the halogen lamp 120, affects the temperature of the members disposed around the pressure roller 140. Further, the term $A_5(TP_{n-1}-TF_{n-1})$ accounts for the transfer of heat between the roller body 142 and members surrounding the roller body 142.

The third term $A_3(TA-TP_{n-1})$ in equation (2) accounts for how conditions around the pressure roller 140 (the fixing unit 8), and specifically the ambient temperature TA and the operating state of the fan 25, influence the temperature of the pressure roller 140. This term is calculated by multiplying the difference between the ambient temperature TA and the penultimate estimated temperature $TP_{n-1}$ by a predetermined third coefficient $A_3$.

The third coefficient $A_3$ is set to a different value depending on the operating state of the fan 25. In the first embodiment, the third coefficient $A_3$ is set to a value greater than the second coefficient $A_2$ and smaller than a value of the first coefficient $A_1$ set when a sheet S is not present between the pressure roller 140 and the fusing belt 110. The value of the third coefficient $A_3$ is set larger when the fan 25 is ON than when the fan 25 is OFF.

2. Calculating the Rate of Change of Velocity

In S120 of FIG. 5, the controller 10 calculates a rate of change of velocity ΔV based on the estimated temperature $TP_n$ of the pressure roller 140, as indicated in equation (4) below.

$$\Delta V=A_6(TP_n-TP_i) \quad \text{equation (4)}$$

In equation (4), $TP_i$ is the temperature of the pressure roller 140 in a reference state (the reference temperature). As an example, the reference temperature $TP_i$ may be set to 25° C. The reference temperature $TP_i$ may also be a variable value and need not be set to a fixed value, such as 25° C. Further, $A_6$ in equation (4) is a coefficient for converting the difference between the temperature $TP_n$ and the reference temperature $TP_i$ of the pressure roller 140 to the rate of change of velocity ΔV and is predetermined through experimentation, simulation, and the like.

3. Setting the Rotational Speed of the Pressure Roller

In S130 the controller 10 sets the rotational speed (target rotational speed VT of the pressure roller 140 on the basis of the rate of change of velocity ΔV calculated in S120 according to equation (5) below.

$$VT=VT_0/(1+\Delta V) \quad \text{equation (5)}$$

In equation (5), $VT_0$ is a predetermined reference target rotational speed $VT_0$ (a fixed value).

The controller 10 controls the rotational speed of the pressure roller 140 by controlling the motor 83 based on the target rotational speed VT set in S130, as described above. In the control process, the controller 10 switches the rotational speed of the pressure roller 140 after the first detection sensor 91 has detected that a single sheet S has passed between the fusing belt 110 and pressure roller 140 (after the preceding sheet has passed over the first detection sensor 91) and before the next sheet S enters between the fusing belt 110 and the pressure roller 140. Thus, the controller 10 switches the target rotational speed VT of the pressure roller 140 from the current target rotational speed VT1 to the newly set target rotational speed VT2.

Figure 6:
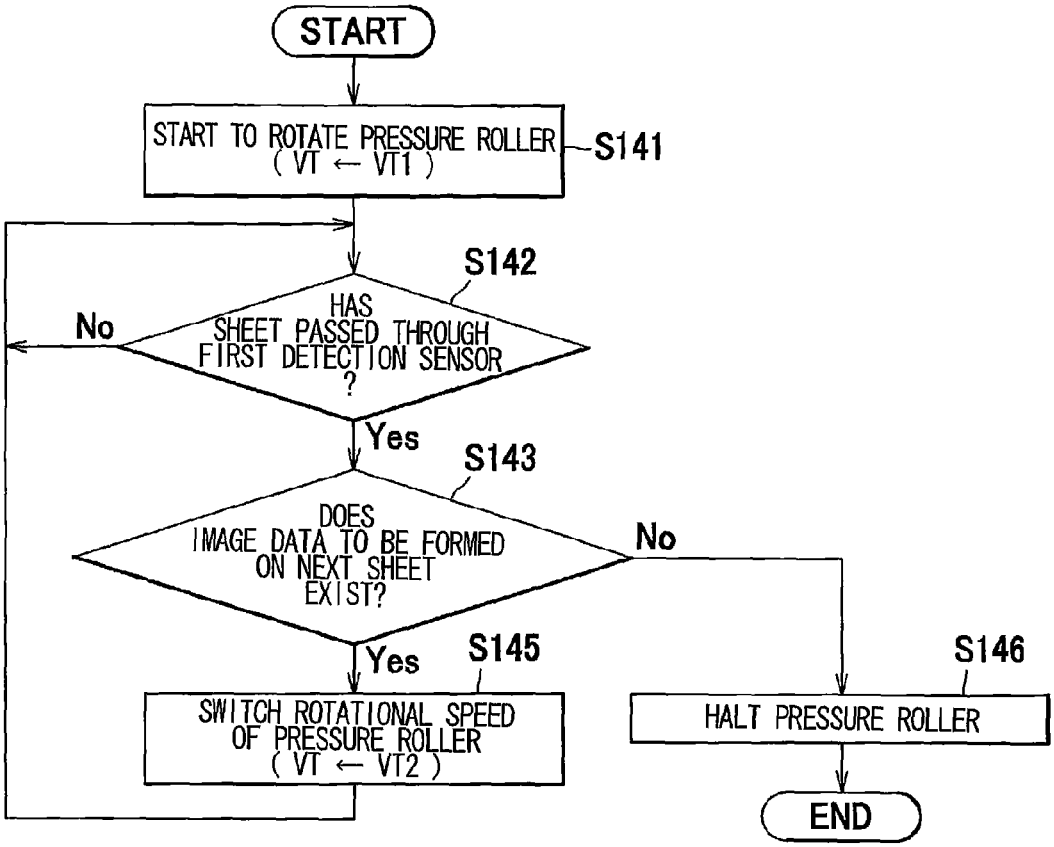
FIG. 6 is a flowchart illustrating a control routine executed in the controller for controlling the rotation speed of the pressure roller according to the first embodiment.

More specifically, the controller 10 performs a process shown in FIG. 6 upon receiving a print job in order to form images on sheets S. In S141 of FIG. 6, the controller 10 sets the target rotational speed VT to the newest target rotational speed VT1 at the current point in time and starts to rotate the pressure roller 140. In other words, the controller 10 controls the rotational speed of the pressure roller 140 on the basis of the temperature TH detected by the thermistors 170 and parameters that cause the temperature of the pressure roller 140 to change. More specifically, the controller 10 controls the rotational speed of the pressure roller 140 to be brought into coincidence with the target rotational speed VT1.

In S142 the controller 10 determines whether a sheet S has passed through the first detection sensor 91. When the sheet S has passed the first detection sensor 91 (S142: YES), in S143 the controller 10 determines whether there exists image data corresponding to an image to be formed on another sheet S. When image data to be formed on another sheet S exists (S143: YES), in S145 the controller 10 switches the target rotational speed VT to the newest target rotational speed VT2 at the current point in time to change the rotational speed of the pressure roller 140. Thereafter, the controller 10 repeats the above process from S142.

When there is no remaining image data to be formed on other sheets S (S143: NO), image formation is complete and in S146 the controller 10 halts the rotation of the pressure roller 140, thereby ending the process. Note that the process in FIG. 5 and the process in FIG. 6 are executed in parallel when a print job is received.

The controller 10 sets the target rotational speed VT of the pressure roller 140 to the reference target rotational speed $VT_0$ in the above printing process when driving the color laser printer 1 from its reference state. As the temperature of the pressure roller 140 rises, the pressure roller 140 expands in diameter. Since the rate of change of velocity ΔV increases as the temperature of the pressure roller 140 rises, the controller 10 sets the target rotational speed VT of the pressure roller 140 to a value smaller than the reference target rotational speed $VT_0$ in order to reduce the rotational speed of the pressure roller 140. In this way, the controller 10 can control the rotation of the pressure roller 140 so that its circumferential speed remains approximately constant, even when the pressure roller 140 increases in diameter, enabling the fixing unit 8 to convey the sheet S at a constant speed.

Further, when a sheet S is conveyed between the fusing belt 110 and pressure roller 140, the sheet S absorbs heat, causing the temperature of the pressure roller 140 to drop and the pressure roller 140 to contract (to approach its original diameter). Since the rate of change of velocity ΔV decreases as the diameter of the pressure roller 140 decreases, the controller 10 sets the target rotational speed VT of the pressure roller 140 to a larger value than when the pressure roller 140 is at a higher temperature, thereby increasing the rotational speed of the pressure roller 140. In this way, the controller 10 can maintain the circumferential speed of the pressure roller 140 at an approximately constant speed, even when the pressure roller 140 decreases in diameter, enabling the fixing unit 8 to convey the sheet S at a constant speed.

In the first embodiment described above, the controller 10 can control the rotational speed of the pressure roller 140 in response to changes in the diameter of the pressure roller 140 caused by fluctuations in temperature, without providing sensors for detecting the temperature of the pressure roller 140.

Further, in the first embodiment the controller 10 changes the rotational speed of the pressure roller 140 after a preceding sheet S has passed through the fusing belt 110 and the pressure roller 140 and before the next sheet S enters between the fusing belt 110 and the pressure roller 140. In this way, the color laser printer 1 can avoid rubbing between the fusing belt 110 and the sheet S that could occur while the sheet S was being conveyed between the fusing belt 110 and the pressure roller 140. Thus, this method prevents the image formed on the sheet S from becoming smeared by such rubbing.

Second Embodiment

Next, a second embodiment will be described, wherein like parts and components are designated with the same reference numerals to avoid duplicating description. A color laser printer 101 according to the second embodiment has the same components as the color laser printer 1 and is also provided with a second detection sensor 92 as shown in FIG. 1.

The second detection sensor 92 is configured to detect the presence of a sheet S being conveyed in the main casing 2. As with the first detection sensor 91, the second detection sensor 92 is primarily configured of an actuator that pivots when contacted by a sheet S, and a photosensor configured to detect the pivoting action of the actuator. The second detection sensor 92 is disposed on the upstream side of the pressure roller 140 with respect to the conveying direction of the sheet S, and specifically is disposed obliquely above and rearward of the registration rollers 37 in the second embodiment. The second detection sensor 92 is configured to output data to the controller 10 indicating whether a sheet S is being detected or not.

When controlling the rotational speed of the pressure roller 140 based on the target rotational speed VT, the controller 10 in the second embodiment changes the rotational speed of the pressure roller 140 after one sheet has passed through the fusing belt 110 and the pressure roller 140 and before the next sheet S enters between the fusing belt 110 and the pressure roller 140. Specifically, in the second embodiment, the controller 10 switches the rotational speed of the pressure roller 140 once a second period of time has elapsed after the second detection sensor 92 has detected the sheet S. The second period of time is an example of a prescribed period of time.

The second period of time is set longer than the time required for the trailing edge of the preceding sheet S to exit from between the fusing belt 110 and the pressure roller 140 after the second detection sensor 92 has detected the next sheet S and shorter than the time required for the leading edge of the next sheet S to enter between the fusing belt 110 and the pressure roller 140 (to reach the nip portion N) after the second detection sensor 92 has detected the next sheet S.

Next, the process according to the second embodiment for controlling the rotational speed of the pressure roller 140 will be described with reference to FIG. 7.

Figure 7:
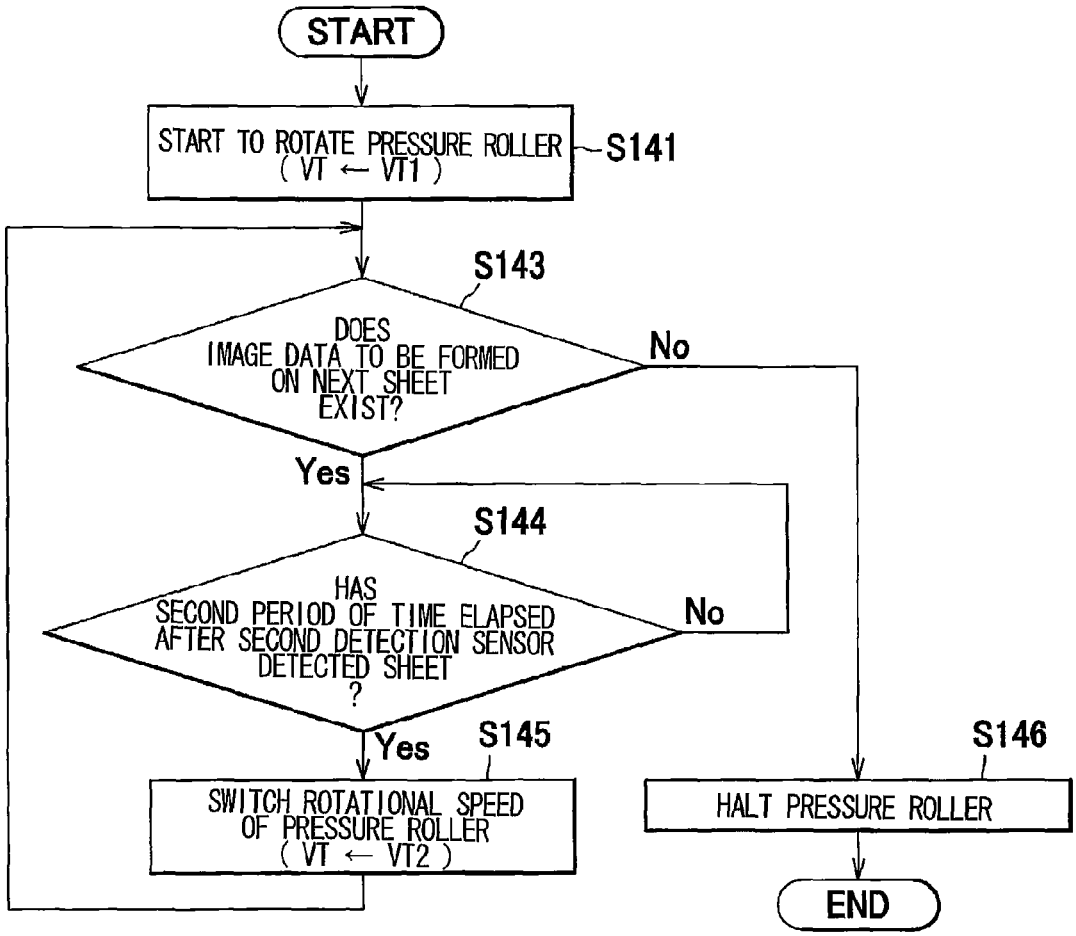
FIG. 7 is a flowchart illustrating a control routine executed in a controller for controlling rotation speed of the pressure roller according to the second embodiment.

The controller 10 performs the process shown in FIG. 7 upon receiving a print job in order to form an image on the sheet S. In S141 of FIG. 7, the controller 10 sets the target rotational speed VT to the newest target rotational speed VT1 at the current point in time and starts to rotate the pressure roller 140. Note that the controller 10 may begin rotating the pressure roller 140 once the second period of time has elapsed after the second detection sensor 92 has detected a sheet S, as is determined in S144 described below.

In S143 the controller 10 determines whether there exists image data corresponding to an image to be formed on another sheet S. When image data corresponding to an image to be formed on another sheet S exists (S143: YES), in S144 the controller 10 determines whether the second period of time has elapsed after the second detection sensor 92 detected a sheet S. If the second period of time has elapsed after the second detection sensor 92 detected a sheet S (S144: YES), in S145 the controller 10 changes the rotational speed of the pressure roller 140 by switching the target rotational speed VT to the newest target rotational speed VT2 at the current point in time. Thereafter, the controller 10 repeats the above process from S143.

When there is no remaining image data to be formed on other sheets S (S143: NO), image formation is complete and in S146 the controller 10 halts the rotation of the pressure roller 140 after the last sheet S has passed through the fusing belt 110 and the pressure roller 140, and specifically after the last sheet S has passed the first detection sensor 91, thereby ending the process in FIG. 7.

With the color laser printer 101 according to the second embodiment described above, the controller 10 can avoid smearing images formed on sheets S by switching the rotational speed of the pressure roller 140 after a preceding sheet S has passed through the fusing belt 110 and the pressure roller 140 and before the next sheet S enters between the fusing belt 110 and the pressure roller 140.

While the description has been described in detail with reference to specific embodiments thereof, it would be apparent to those skilled in the art that many modifications and variations may be made therein without departing from the spirit of the above described disclosures.

In the first and second embodiments described above, the sheet temperature TS is set to the ambient temperature TA when an image is being formed on the first surface of the sheet S, and is set to the sum of the ambient temperature TA and the calibration temperature TB when an image is being formed on the second surface of the sheet S, but the sheet temperature TS is not limited to these settings. For example, if a color laser printer is not provided with an ambient temperature sensor, the sheet temperature may be set to a predetermined first fixed value when forming an image on the first surface of the sheet S, and a predetermined second fixed value when forming an image on the second surface of the sheet S. Alternatively, if the sheet temperature is set on the basis of the detected value outputted from an ambient temperature sensor, the sheet temperature may be set to the average detected value outputted from the sensor over a time interval that begins a prescribed time before the timing for estimating the temperature of the pressure roller and that ends at the timing for estimating the temperature of the pressure roller. Further, the color laser printer may be provided with a temperature sensor for detecting the temperature of the sheets of paper and may set the sheet temperature to the temperature detected by this temperature sensor.

In the first and second embodiments described above, the temperature detected by the ambient temperature sensor 81 is used as the ambient temperature (the temperature in the operating environment of the color laser printer), but another temperature may be used as the ambient temperature. For example, a preset fixed value such as 25° C. may be used as the ambient temperature when the color laser printer is not provided with an ambient temperature sensor.

In the first and second embodiments described above, the fan 25 has two operating states, an ON state and an OFF state, and the third coefficient $A_3$ is set to different values depending on whether the fan 25 is ON or OFF. However, if the fan has three operating states, such as a state of rotating at a prescribed speed, a state of rotating at a slower speed than the prescribed speed, and an OFF state (halted state), the third coefficient $A_3$ may be set to different values for each of the three operating states. The same holds true if the fan has four or more operating states.

In the first and second embodiments described above, the controller 10 is configured to: estimate the temperature of the pressure roller 140 on the basis of the temperature detected by the thermistors 170 and parameters that cause the temperature of the pressure roller 140 to change; and set the rotational speed of the pressure roller 140 on the basis of the estimated temperature of the pressure roller 140. However, the controller may be configured to set the rotational speed of the pressure roller 140 directly based on the temperature detected by the thermistors 170 and the parameters that influence the temperature of the pressure roller, for example.

In the first and second embodiments described above, the ambient temperature TA, operating state of the fan 25, existence or non-existence of sheet S between the fusing belt 110 and the pressure roller 140, and rotation or non-rotation of the pressure roller 140 are used as examples of parameters effecting on the temperature of the pressure roller 140. However, other parameters may be used. For example, kind of sheets in terms of thickness, size and material of the sheets, rotation speed of the pressure roller during rotation state thereof, and temperature of the sheet in case where a sheet temperature sensor is provided can be used as parameters effecting on the temperature of the pressure roller.

Further, the number of parameters effecting on the temperature of the pressure roller is four in the first and second embodiment. However, the number of parameters is not limited to four, but the number of parameters can be changed dependent on existence or non-existence of ambient temperature sensor and the fan.

In the first and second embodiments described above, the temperature detection member such as the thermistor 170 is configured to detect the temperature of the nip plate 130. However, the temperature detection member can be configured to detect temperature of the fusing belt.

In the first and second embodiments described above, the motor 83 for applying driving force to the pressure roller 140 is provided independent of other motor for applying driving force to the image forming unit 4, etc. However, the driving system is not limited to that in the embodiments. For example, drive source for applying driving force to the pressure roller can be the motor for applying the driving force to the image forming unit. In the latter case, a shift transmission mechanism can be provided between the motor and the pressure roller to change the rotation speed of the pressure roller.

In the first and second embodiments described above, the fan 25 is provided at the discharge opening formed in the housing 2. However, the fan 25 can be provided at an inlet opening of the housing 2.

Modification to the pressure roller is conceivable. For example, in the first and second embodiments, the cored bar 141A of the shaft 141 of the pressure roller 140 is a hollow structure. However, a rigid shaft is available. Further, in the first and second embodiments, the roller body 142 is made from rubber. However, any elastic material other than rubber is available as a material of the roller body.

Further, in the first and second embodiments described above, the flexible endless fusing belt 110 is used as an example of the heated member. However, a hollow metallic member which will be referred to as a heat roller or a fixing roller is also available as the heated member.

Further, in the first and second embodiments described above, the halogen lamp (halogen heater) 120 is used as an example of the heater for heating the heated member. However, a ceramic heater, a carbon heater, and IH heater are also available instead of the halogen heater.

Further, in the first and second embodiments, the plate-like nip plate 130 is used as an example of the nip member. However, a thick component other than plate-like component is also available as the nip member.

Further, in the first and second embodiments, as the image forming apparatus, the color laser printer 1 is exemplified in which a plurality of developing cartridges 63 are provided. However, a monochromatic printer in which only one developing cartridge is provided is also available as the image forming apparatus. Further, instead of the image forming apparatus capable of forming images on both surfaces of the sheet, an image forming apparatus forming an image on a single surface of the sheet is also available. Further, instead of the printer, a copying machine and a facsimile machine those having an original image reader such as a flat-bed scanner are available as the image forming apparatus. Further, in the first and second embodiments, the exposure unit 5 is configured to emit laser beam onto the photosensitive drums 61. However, an exposure system is not limited to laser beam emission onto the photosensitive drum, but other type of exposure system such as light emission from LED onto the drum is also available.

Further, in the first and second embodiments, the plain paper is used as the sheet S. However, a sheet other than the plain paper such as OHP sheet is also available.

What is claimed is:

1. An image forming apparatus comprising:

a heat unit including a heater and a heated member configured to be heated by the heater;

a pressure roller configured to rotate at a rotational speed while being in contact with the heated member upon receiving a driving force;

a temperature sensor configured to detect a temperature of the heat unit; and a controller configured to:

estimate a temperature of the pressure roller based on: the temperature detected by the temperature sensor; and a parameter that causes temperature of the pressure roller to change;

determine a target rotational speed of the pressure roller based on the estimated-temperature of the pressure roller;

repeatedly update the estimated-temperature of the pressure roller, the updated estimated-temperature being determined by adding a change amount in temperature to a penultimate estimated-temperature of the pressure roller, the change amount in temperature being calculated using a first term, the first term being determined by multiplying a difference between a nip temperature and the penultimate estimated-temperature by a first coefficient, the nip temperature being a temperature at a nip portion formed between the pressure roller and the heated member, the first coefficient being set to a different value depending on whether the pressure roller is rotating or not, the parameter including a status whether the pressure roller is rotating or not; and control the rotational speed of the pressure roller to be brought into coincidence with the target rotational speed.

2. The image forming apparatus according to claim 1, wherein, when the pressure roller is rotating, the first coefficient is set to a different value depending on existence or non-existence of a sheet between the pressure roller and the heated member, the parameter including the existence or non-existence of a sheet between the pressure roller and the heated member.

3. The image forming apparatus according to claim 1, wherein the nip temperature is set to a temperature of a sheet when the sheet is present between the pressure roller and the heated member, and wherein the nip temperature is set to the temperature detected by the temperature sensor when a sheet is not present between the pressure roller and the heated member.

4. The image forming apparatus according to claim 1, wherein the change amount in temperature is calculated further using a second term, the second term being determined by multiplying a difference between a temperature of a member disposed around the pressure roller and the penultimate estimated-temperature by a second coefficient.

5. The image forming apparatus according to claim 4, wherein the temperature of the member disposed around the pressure roller is calculated using a following equation:

$$TF_n = TF_{n-1} + \{A_4(TH - TF_{n-1}) + A_5(TP_{n-1} - TF_{n-1})\}$$

Where $TF_n$ is the temperature of the member, $TF_{n-1}$ is a penultimate temperature of the member, TH is the temperature detected by the temperature sensor, $TP_{n-1}$ is the penultimate estimated-temperature, and $A_4$ and $A_5$ are preset coefficients.

6. The image forming apparatus according to claim 5, wherein the change amount in temperature is calculated further using a third term, the third term being determined by multiplying a difference between ambient temperature and the penultimate estimated-temperature by a third coefficient, the parameter including the ambient temperature.

7. The image forming apparatus according to claim 6, further comprising:

a housing; and a fan configured to cool an interior of the housing, wherein the third coefficient is set to a different value depending on an operating state of the fan, the parameter including the operating state of the fan.

8. The image forming apparatus according to claim 6, further comprising an ambient temperature sensor disposed apart from both the heat unit and the pressure roller, wherein the ambient temperature is based on a value detected by the ambient temperature sensor.

9. The image forming apparatus according to claim 8, wherein the heated member includes an endless belt configured to rotate and having an inner circumferential surface;

wherein the heat unit includes a nip member configured to contact the inner circumferential surface of the endless belt while nipping the heated member in cooperation with the pressure roller; and wherein the temperature sensor is configured to detect temperature of the nip member as the temperature of the heat unit.

10. An image forming apparatus comprising:

a heat unit including a heater and a heated member configured to be heated by the heater;

a pressure roller configured to rotate at a rotational speed while being in contact with the heated member upon receiving a driving force;

a temperature sensor configured to detect a temperature of the heat unit;

a sheet sensor configured to detect a sheet being passed therethrough, the sheet sensor being disposed at at least one of: a position downstream of the pressure roller in a conveying direction in which the sheet is conveyed; and a position upstream of the pressure roller in the conveying direction, and a controller configured to:

control the rotational speed of the pressure roller based on: the temperature detected by the temperature sensor; and a parameter that causes temperature of the pressure roller to change, and switch the rotational speed of the pressure roller after one sheet has passed between the heated member and the pressure roller and before a subsequently-conveyed sheet enters between the heated member and the pressure roller, wherein the controller switches the rotational speed of the pressure roller after the one sheet has been passed through the sheet sensor.

11. The image forming apparatus according to claim 10, wherein the heated member includes an endless belt configured to rotate and having an inner circumferential surface;

wherein the heat unit includes a nip member configured to contact the inner circumferential surface of the endless belt while nipping the heated member in cooperation with the pressure roller; and wherein the temperature sensor is configured to detect temperature of the nip member as the temperature of the heat unit.

12. An image forming apparatus comprising:

a heat unit including a heater and a heated member configured to be heated by the heater;

a pressure roller configured to rotate at a rotational speed while being in contact with the heated member upon receiving a driving force;

a temperature sensor configured to detect a temperature of the heat unit; and a controller configured to:

estimate a temperature of the pressure roller based on: the temperature detected by the temperature sensor; and a parameter that causes temperature of the pressure roller to change;

determine a target rotational speed of the pressure roller based on the estimated-temperature of the pressure roller;

repeatedly update the estimated-temperature of the pressure roller, the updated estimated-temperature being determined by adding a change amount in temperature to a penultimate estimated-temperature of the pressure roller, the change amount in temperature being calculated using a term, the term being determined by multiplying a difference between a nip temperature and the penultimate estimated-temperature by a coefficient, the nip temperature being a temperature at a nip portion formed between the pressure roller and the heated member, the nip temperature being set to a temperature of a sheet when the sheet is present between the pressure roller and the heated member, the nip temperature being set to the temperature detected by the temperature sensor when a sheet is not present between the pressure roller and the heated member; and control the rotational speed of the pressure roller to be brought into coincidence with the target rotational speed.

13. The image forming apparatus according to claim 12, further comprising an ambient temperature sensor disposed apart from both the heat unit and the pressure roller, wherein the temperature of the sheet is based on a value detected by the ambient temperature sensor.

14. The image forming apparatus according to claim 13, wherein the heated member includes an endless belt configured to rotate and having an inner circumferential surface;

wherein the heat unit includes a nip member configured to contact the inner circumferential surface of the endless belt while nipping the heated member in cooperation with the pressure roller; and wherein the temperature sensor is configured to detect temperature of the nip member as the temperature of the heat unit.

15. An image forming apparatus comprising:

a heat unit including a heater and a heated member configured to be heated by the heater;

a pressure roller configured to rotate at a rotational speed while being in contact with the heated member upon receiving a driving force;

a temperature sensor configured to detect a temperature of the heat unit; and a controller configured to:

estimate a temperature of the pressure roller based on: the temperature detected by the temperature sensor; and a parameter that causes temperature of the pressure roller to change;

determine a target rotational speed of the pressure roller based on the estimated-temperature of the pressure roller;

repeatedly update the estimated-temperature of the pressure roller, the updated estimated-temperature being determined by adding a change amount in temperature to a penultimate estimated-temperature of the pressure roller, the change amount in temperature being calculated using a term, the term being determined by multiplying a difference between a temperature of a member disposed around the pressure roller and the penultimate estimated-temperature by a coefficient; and control the rotational speed of the pressure roller to be brought into coincidence with the target rotational speed, wherein the temperature of the member disposed around the pressure roller is calculated using a following equation:

$$TF_n = TF_{n-1} + \{A_4(TH - TF_{n-1}) + A_5(TP_{n-1} - TF_{n-1})\}$$

Where $TF_n$ is the temperature of the member, $TF_{n-1}$ is a penultimate temperature of the member, TH is the temperature detected by the temperature sensor, $TP_{n-1}$ is the penultimate estimated-temperature, and $A_4$ and $A_5$ are preset coefficients.

16. The image forming apparatus according to claim 15, wherein the heated member includes an endless belt configured to rotate and having an inner circumferential surface;

wherein the heat unit includes a nip member configured to contact the inner circumferential surface of the endless belt while nipping the heated member in cooperation with the pressure roller; and wherein the temperature sensor is configured to detect temperature of the nip member as the temperature of the heat unit.

17. An image forming apparatus comprising:

a heat unit including a heater and a heated member configured to be heated by the heater;

a pressure roller configured to rotate at a rotational speed while being in contact with the heated member upon receiving a driving force;

a temperature sensor configured to detect a temperature of the heat unit; and a controller configured to:

estimate a temperature of the pressure roller based on: the temperature detected by the temperature sensor; and a parameter that causes temperature of the pressure roller to change;

determine a target rotational speed of the pressure roller based on the estimated-temperature of the pressure roller;

repeatedly update the estimated-temperature of the pressure roller, the updated estimated-temperature being determined by adding a change amount in temperature to a penultimate estimated-temperature of the pressure roller, the change amount in temperature being calculated using a term, the term being determined by multiplying a difference between ambient temperature and the penultimate estimated-temperature by a coefficient, the parameter including the ambient temperature; and control the rotational speed of the pressure roller to be brought into coincidence with the target rotational speed.

18. The image forming apparatus according to claim 17, further comprising an ambient temperature sensor disposed apart from both the heat unit and the pressure roller, wherein the ambient temperature is based on a value detected by the ambient temperature sensor.

19. The image forming apparatus according to claim 18, further comprising:

a housing; and a fan configured to cool an interior of the housing, wherein the coefficient is set to a different value depending on an operating state of the fan, the parameter including the operating state of the fan.

20. The image forming apparatus according to claim 19, wherein the heated member includes an endless belt configured to rotate and having an inner circumferential surface;

wherein the heat unit includes a nip member configured to contact the inner circumferential surface of the endless belt while nipping the heated member in cooperation with the pressure roller; and wherein the temperature sensor is configured to detect temperature of the nip member as the temperature of the heat unit.

* * * * *